US007389738B1

(12) United States Patent
Walczykowski

(10) Patent No.: US 7,389,738 B1
(45) Date of Patent: Jun. 24, 2008

(54) CONVERTIBLE TABLE SYSTEM

(76) Inventor: Richard S. Walczykowski, 343 Co. Rd. 427, Killen, AL (US) 35645

( * ) Notice: Subject to any disclaimer, the term of this patent is extended or adjusted under 35 U.S.C. 154(b) by 0 days.

(21) Appl. No.: 11/796,704

(22) Filed: Apr. 30, 2007

(51) Int. Cl.
*B63B 17/00* (2006.01)

(52) U.S. Cl. ..... 114/363

(58) Field of Classification Search ..... 114/363, 114/188

See application file for complete search history.

(56) References Cited

U.S. PATENT DOCUMENTS

| | | | | |
|---|---|---|---|---|
| D260,705 | S | | 9/1981 | Zamora |
| 4,919,068 | A | | 4/1990 | Lathers |
| 4,924,798 | A | | 5/1990 | Lathers |
| 4,925,245 | A | | 5/1990 | Pendleton et al. |
| 4,932,718 | A | * | 6/1990 | Yamazaki ..... 297/146 |
| D324,460 | S | | 3/1992 | Murray |
| 5,315,726 | A | | 5/1994 | Borenstein |
| 5,515,900 | A | * | 5/1996 | West et al. ..... 160/135 |
| 5,549,072 | A | | 8/1996 | Maloney |
| 6,065,422 | A | | 5/2000 | Davidson et al. |
| 6,431,109 | B1 | | 8/2002 | Martin |
| 2003/0075098 | A1 | | 4/2003 | Huse |

* cited by examiner

*Primary Examiner*—Stephen Avila

(57) ABSTRACT

A convertible table system for providing a table and then being convertible to a seat on a boat includes a pedestal being mounted to and extending upwardly from a deck of the boat. A conversion assembly is mounted to the pedestal to position the conversion assembly above the deck. The conversion assembly is actuatable between a table position and a chair position.

20 Claims, 4 Drawing Sheets

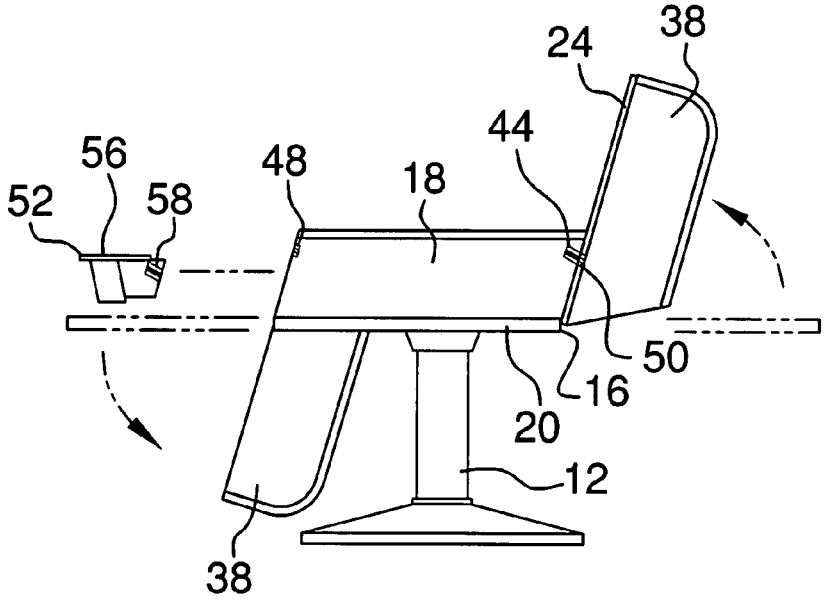
FIG. 5
FIG. 6
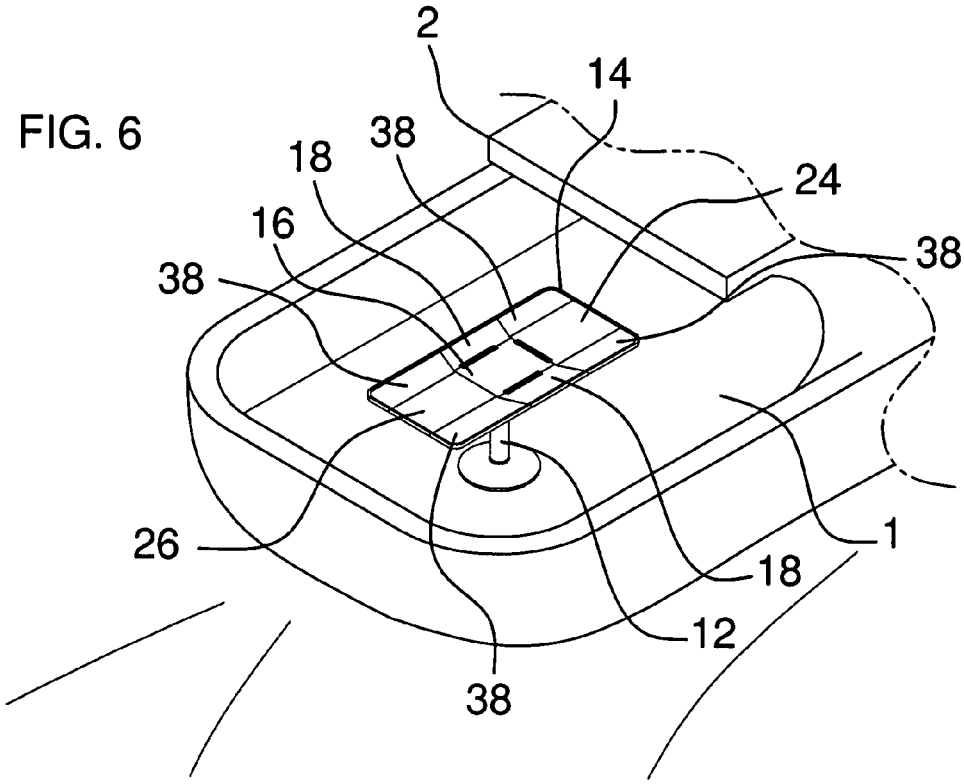

CONVERTIBLE TABLE SYSTEM

BACKGROUND OF THE INVENTION

1. Field of the Invention

The present invention relates to multifunction boat seats and more particularly pertains to a new multifunction boat seat for providing a seat on a boat that is convertible into a table.

2. Description of the Prior Art

The use of multifunction boat seats is known in the prior art. While these devices fulfill their respective, particular objectives and requirements, the need remains for a system that has certain improved features that allow for the system to be used to be easily converted from a table to a chair without the need to disassemble any of the system. Additionally, the system should include an accessory that mounted to the system when the system is a chair to allow the support of objects to be used by a person sitting on the system.

SUMMARY OF THE INVENTION

The present invention meets the needs presented above by generally comprising a pedestal being mounted to and extending upwardly from a deck of the boat. A conversion assembly is mounted to the pedestal to position the conversion assembly above the deck. The conversion assembly is actuatable between a table position and a chair position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an exploded side view of the present invention in the chair position.

FIG. 6 is a top perspective view of the present invention in the table position in use on a boat.

DESCRIPTION OF THE PREFERRED EMBODIMENT

Figure 1:
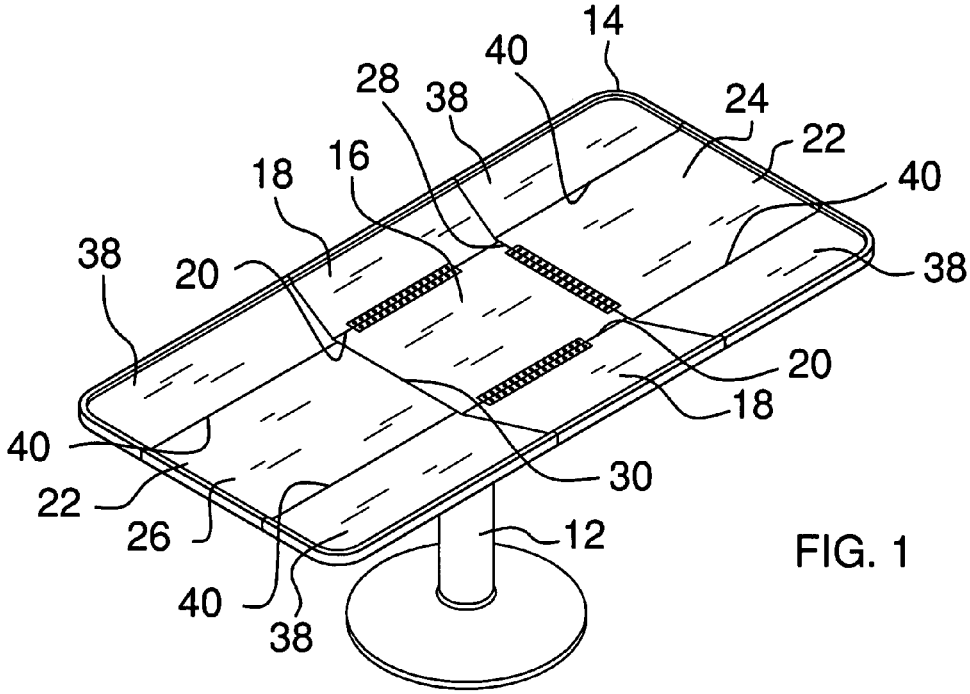
FIG. 1 is a top perspective view of a convertible table system according to the present invention shown in the table position.
Figure 2:
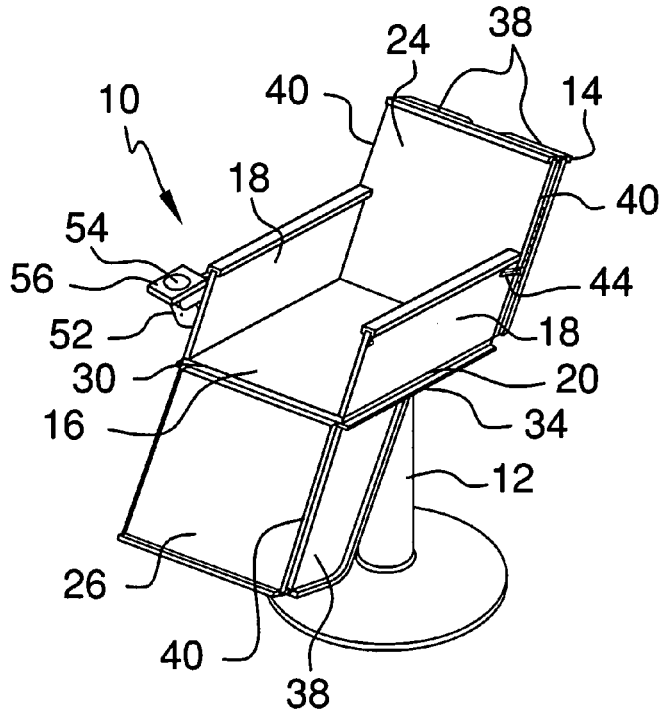
FIG. 2 is a top perspective view of the present invention shown in the chair position.
Figure 3:
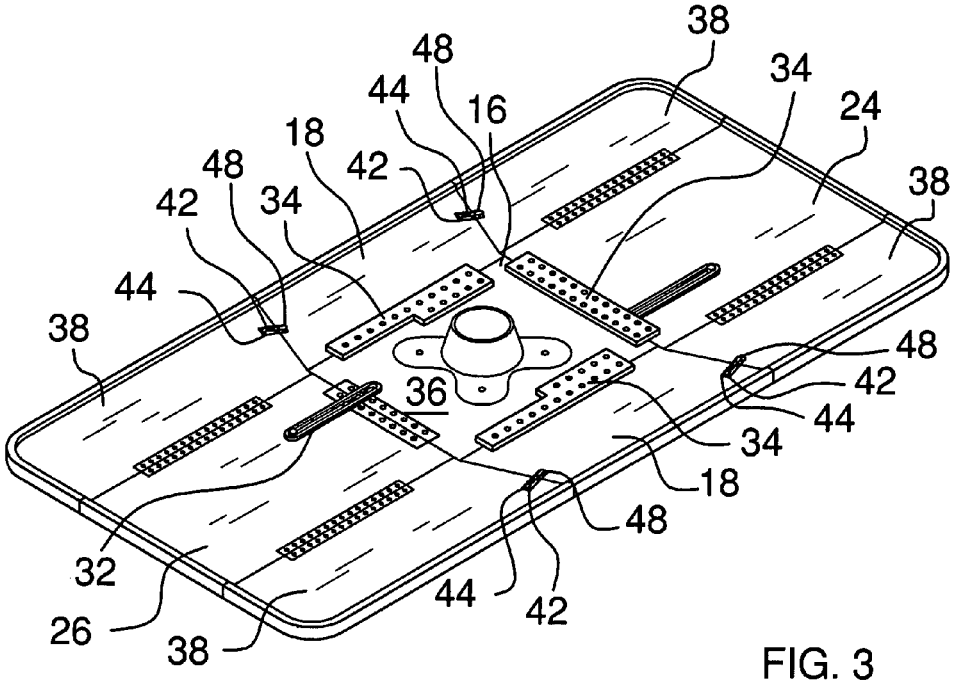
FIG. 3 is a bottom perspective view of the conversion assembly of the present invention.
Figure 4:
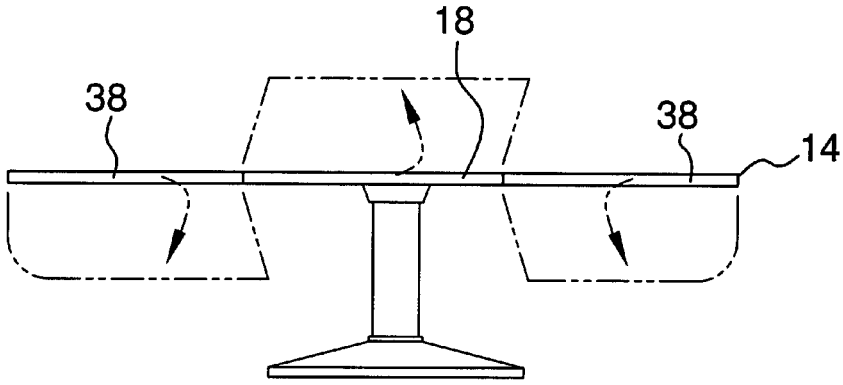
FIG. 4 is a side view of the present invention in the table position.
Figure 7:
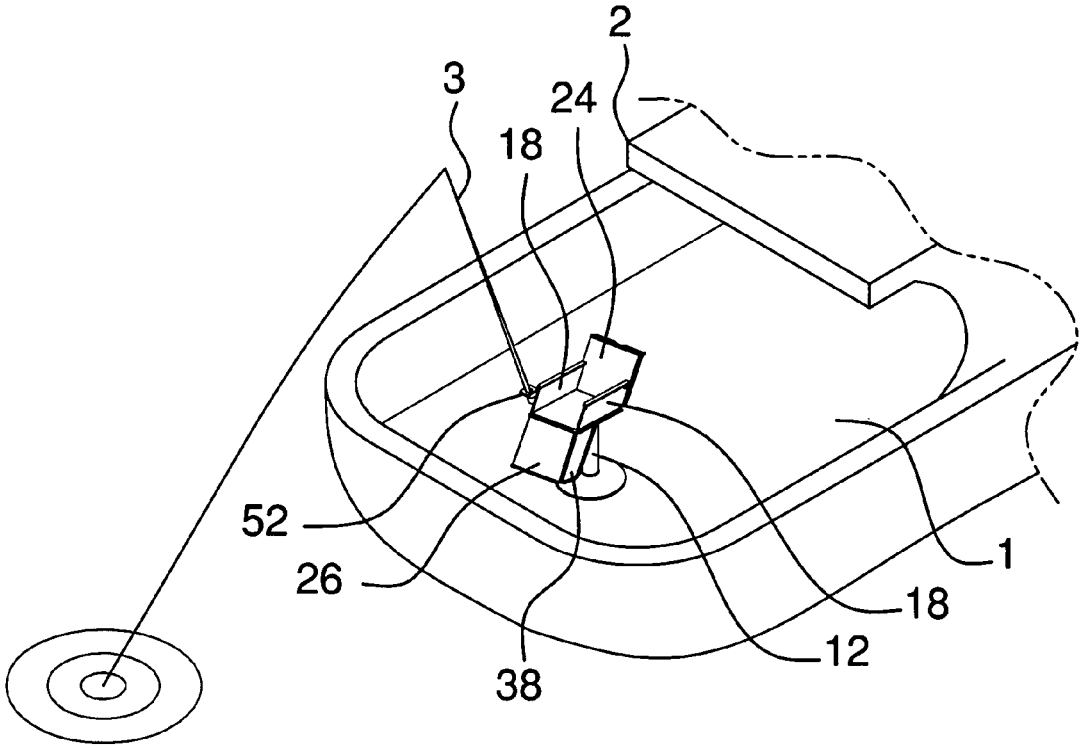
FIG. 7 is a top perspective view of the present invention in the chair position in use on the boat.
Figure 8:
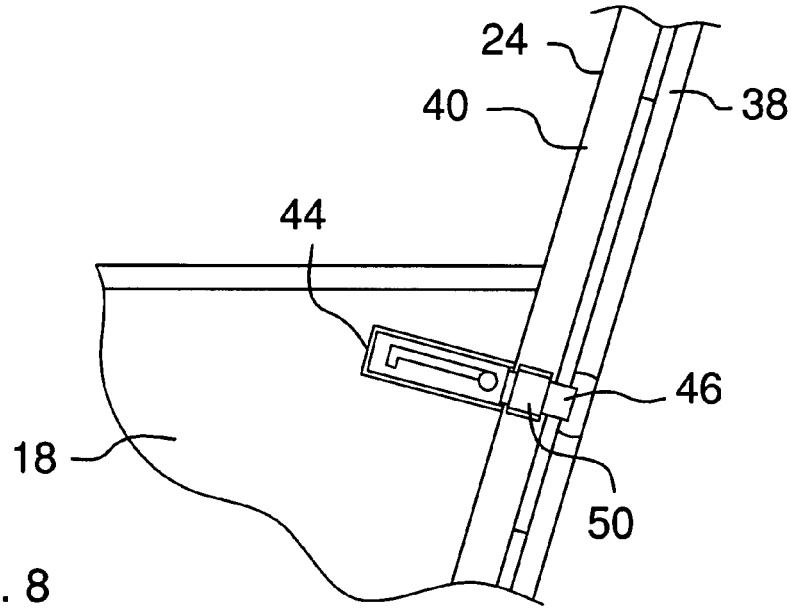
FIG. 8 is an enlarged side view of the mounting plate, bar and upright hasp of the present invention

With reference now to the drawings, and in particular to FIGS. 1 through 8 thereof, a new multifunction boat seat embodying the principles and concepts of the present invention and generally designated by the reference numeral 10 will be described.

As best illustrated in FIGS. 1 through 8, the convertible table system 10 generally comprises a pedestal 12 being mounted to and extending upwardly from a deck 1 of a boat 2. A conversion assembly 14 is mounted to the pedestal 12 to position the conversion assembly 14 above the deck 1. The conversion assembly 14 is actuatable between a table position and a chair position.

The conversion assembly 14 includes a base plate 16 mounted to the pedestal 12. The base plate 16 is oriented approximately parallel to the deck 1. A pair of side plates 18 is hingedly coupled to the base plate 16. Each of the side plates 18 is positioned horizontally and aligned with the base plate 16 when the conversion assembly 14 is in the table position. Each of a pair of side edges 20 has one of the side plates 18 hingedly coupled adjacent thereto and extending upwardly therefrom when the conversion assembly 14 is in the chair position.

The conversion assembly 14 additionally includes a pair of end plates 22 hingedly coupled to the base plate 16. Each of the end plates 22 is positioned horizontally and aligned with the base plate 16 when the conversion assembly 14 is in the table position. The end plates 22 include a rear plate 24 and a front plate 26. A rear edge 28 of the base plate 16 has the rear plate 24 hingedly coupled adjacent thereto and extending upwardly therefrom when the conversion assembly 14 is in the chair position. A front edge 30 of the base plate 16 has the front plate 26 hingedly coupled adjacent thereto and extending downwardly therefrom when the conversion assembly 14 is in the chair position. An extension bar 32 is slidably coupled to the front plate 26. The extension bar 32 is slid under the base plate 16 to inhibit downward pivoting of the associated one of the end plates 22 when the conversion assembly 14 is in the table position.

The conversion assembly 14 also includes a plurality of abutment plates 34 coupled to a bottom surface 36 of the base plate 16. Each of the side edges 20 has one of the abutment plates 34 coupled adjacent thereto and extending outwardly therefrom. The rear edge 28 of the base plate 16 has one of the abutment plates 34 coupled adjacent thereto and extending outwardly therefrom. The abutment plates 34 abut the side plates 18 and the rear plate 24 to keep the side plates 18 and the rear plate 24 approximately horizontal when the conversion assembly 14 is in the table position.

Additionally, the conversion assembly 14 includes a plurality of wing plates 38. Each of a pair of longitudinal edges 40 of each of the end plates 22 has one of the wing plates 38 hingedly coupled adjacent thereto. A pair of the wing plates 38 is aligned with one of the side plates 18 when the conversion assembly 14 is in the table position. Each of the wing plates 38 is secured to one of the side plates 18 to maintain positioning of the wing plates 38 when the conversion assembly 14 is in the table position. The wing plates 38 are extended downwardly from the end plates 22 to permit the end plates 22 to be pivoted with respect to the base plate 16.

The conversion assembly 14 includes a plurality of lock assemblies 42 coupled to the side plates 18 and the wing plates 38. The lock assemblies 42 secure the wing plates 38 to the side plates 18 when the conversion assembly 14 is in the table position. The lock assemblies 42 are actuated to permit separation of the wing plates 38 from the side plates 18 when the conversion assembly 14 is being manipulated into the chair position. Each of the lock assemblies 42 includes a mounting plate 44. Each of the side plates 18 has the mounting plate 44 of one of the lock assemblies 42 mounted thereto. Each of the wing plates 38 hingedly coupled to the front plate 26 has the mounting plate 44 of one of the lock assemblies 42 coupled thereto.

Each of the lock assemblies 42 includes a bar 46 slidably coupled to the mounting plate 44. The bar 46 is slid between a retracted state and an extended state. A securing hasp 48 slidably receives the bar 46 when the bar 46 is in the extended state from the mounting plate 44 to secure the wing plates 38 to the side plates 18. Each of the side plates 18 has the securing hasp 48 of one of the lock assemblies 42 coupled thereto and aligned with the mounting plate 44 mounted to one of the wing plates 38 hingedly coupled to the front plate 26. Each of the wing plates 38 hingedly coupled to the rear plate 24 has the securing hasp 48 of one of the lock assemblies 42 coupled thereto and aligned with the mounting plate 44 coupled to and adjacently positioned one of the side plates 18.

The conversion assembly 14 also includes a pair of upright hasps 50. Each of the longitudinal edges 40 of the rear plate 24 has one of the upright hasps 50 coupled thereto. Each of the upright hasps 50 receives the bar 46 mounted to an adjacently position one of the side plates 18 to secure the rear plate 24 to the side plates 18 when the side plates 18 and the rear plate 24 are in the upright position.

At least one accessory 52 is mountable to one of the side plates 18 when the conversion assembly 14 is in the chair position. The at least one accessory 52 has an aperture 54 extending through an upper face 56 thereof. The aperture 54 of the at least one accessory 52 receives an object 3, such as a drink or a fishing pole, to support the object 3 from the associated one of the side plates 18. A securing assembly 58 is coupled to the at least one accessory 52 to engage the securing hasp 48 coupled to the associated one of the side plates 18 and secure the at least one accessory 52 to the associated one of the side plates 18.

In use, the conversion assembly 14 is used like a table when the conversion assembly 14 is in the table position. The lock assemblies 42 are actuated to release the wing plates 38 from the side plates 18. The side plates 18 are pivoted upwardly to extend upwardly from the base plate 16. The wing plates 38 coupled to the rear plate 24 are pivoted and positioned behind the rear plate 24. The rear plate 24 is lifted to abut the side plates 18 and the bar 46 of each of the lock assemblies 42 coupled to the side plates 18 is extended through the upright hasps 50 to secure the rear plate 24 in an upright position. The wing plates 38 coupled to the front plate 26 are pivoted downward. The extension bar 32 is retracted under the front plate 26 to allow the front plate 26 to pivot downwardly so the wing plates 38 abut the bottom surface 36 of the base plate 16 to prevent further pivoting of the front plate 26 under the base plate 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A convertible table system for saving space on a boat, said device comprising:

a pedestal being mounted to and extending upwardly from a deck of the boat; and a conversion assembly being mounted to said pedestal to position said conversion assembly above the deck, said conversion assembly being actuatable between a table position and a chair position;

a base plate being mounted to the pedestal, said base plate being orientated approximately parallel to the deck;

a pair of side plates being hingedly coupled to said base plate, each of said side plates being positioned horizontally and aligned with said base plate when said conversion assembly is in the table position, each of a pair of side edges having one of said side plates hingedly coupled adjacent thereto and extending upwardly therefrom when said conversion assembly is in the chair position;

a pair of end plates being hingedly coupled to said base plate, each of said end plates being positioned horizontally and aligned with said base plate when said conversion assembly is in the table position, said end plates including a rear plate and a front plate, a rear edge of said base plate having said rear plate hingedly coupled adjacent thereto and extending upwardly therefrom when said conversion assembly is in the chair position, a front edge of said base plate having said front plate hingedly coupled adjacent thereto and extending downwardly therefrom when said conversion assembly is in the chair position; and a plurality of abutment plates being coupled to a bottom surface of said base plate, each of said side edges having one of said abutment plates coupled adjacent thereto and extending outwardly therefrom, said abutment plates abutting said side plates to keep said side plates approximately horizontal when said conversion assembly is in the table position.

2. The system according to claim 1, wherein said rear edge of said base plate has one of said abutment plates coupled adjacent thereto and extending outwardly therefrom, said abutment plate abutting said rear plate to keep said rear plate approximately horizontal when said conversion assembly is in the table position.

3. The system according to claim 1, wherein said conversion assembly includes an extension bar being slidably coupled to said front plate, said extension bar being slid under said base plate to inhibit downward pivoting of the associated one of said end plates when said conversion assembly is in the table position.

4. The system according to claim 1, wherein said conversion assembly includes a plurality of wing plates, each of a pair of longitudinal edges of each of said end plates having one of said wing plates hingedly coupled adjacent thereto, a pair of said wing plates being aligned with one of said side plates when said conversion assembly is in the table position, each of said wing plates being secured to one of said side plates to maintain positioning of said wing plates when said conversion assembly is in the table position, said wing plates being extended downwardly from said end plates to permit said end plates to be pivoted with respect to said base plate.

5. The system according to claim 4, wherein said conversion assembly includes a plurality of lock assemblies being coupled to said side plates and said wing plates, said lock assemblies securing said wing plates to said side plates when said conversion assembly is in the table position, said lock assemblies being actuated to permit separation of said wing plates from said side plates when said conversion assembly is being manipulated into the chair position.

6. The system according to claim 5, wherein each of said lock assemblies includes a mounting plate, each of said side plates having said mounting plate of one of said lock assemblies mounted thereto, each of said wing plates hingedly coupled to said front plate having said mounting plate of one of said lock assemblies coupled thereto.

7. The system according to claim 6, wherein each of said lock assemblies includes a bar being slidably coupled to said mounting plate, said bar being slid between a retracted state and an extended state.

8. The system according to claim 7, wherein each of said lock assemblies includes a securing hasp slidably receiving said bar when said bar is in the extended state from said mounting plate to secure said wing plates to said side plates, each of said side plates having said securing hasp of one of said lock assemblies coupled thereto and aligned with said mounting plate mounted to one of said wing plates hingedly coupled to said front plate, each of said wing plates hingedly coupled to said rear plate having said securing hasp of one of said lock assemblies coupled thereto and aligned with said mounting plate coupled to and adjacently positioned one of said side plates.

9. The system according to claim 7, wherein each of said lock assemblies includes a pair of upright hasps, each of said longitudinal edges of said rear plate having one of said upright hasps coupled thereto, each of said upright hasps receiving said bar mounted to an adjacently position one of said side plates to secure said rear plate to said side plates when said side plates and said rear plate are in the upright position.

10. The system according to claim 1, further comprising at least one accessory being mountable to one of said side plates when said conversion assembly is in the chair position, said at least one accessory receiving an object to support that object from the associated one of said side plates.

11. A convertible table system for saving space on a boat, said device comprising:

a pedestal being mounted to and extending upwardly from a deck of the boat;

a conversion assembly being mounted to said pedestal to position said conversion assembly above the deck, said conversion assembly being actuatable between a table position and a chair position, said conversion assembly comprising:

a base plate being mounted to the pedestal, said base plate being orientated approximately parallel to the deck;

a pair of side plates being hingedly coupled to said base plate, each of said side plates being positioned horizontally and aligned with said base plate when said conversion assembly is in the table position, each of a pair of said edges having one of said side plates hingedly coupled adjacent thereto and extending upwardly therefrom when said conversion assembly is in the chair position;

a pair of end plates being hingedly coupled to said base plate, each of said end plates being positioned horizontally and aligned with said base plate when said conversion assembly is in the table position, said end plates including a rear plate and a front plate, a rear edge of said base plate having said rear plate hingedly coupled adjacent thereto and extending upwardly therefrom when said conversion assembly is in the chair position, a front edge of said base plate having said front plate hingedly coupled adjacent thereto and extending downwardly therefrom when said conversion assembly is in the chair position;

a plurality of abutment plates being coupled to a bottom surface of said base plate, each of said side edges having one of said abutment plates coupled adjacent thereto and extending outwardly therefrom, said rear edge of said base plate having one of said abutment plates coupled adjacent thereto and extending outwardly therefrom, said abutment plates abutting said side plates and said rear plate to keep said side plates and said rear plate approximately horizontal when said conversion assembly is in the table position;

a plurality of wing plates, each of a pair of longitudinal edges of each of said end plates having one of said wing plates hingedly coupled adjacent thereto, a pair of said wing plates being aligned with one of said side plates when said conversion assembly is in the table position, each of said wing plates being secured to one of said side plates to maintain positioning of said wing plates when said conversion assembly is in the table position, said wing plates being extended downwardly from said end plates to permit said end plates to be pivoted with respect to said base plate;

an extension bar being slidably coupled to said front plate, said extension bar being slid under said base plate to inhibit downward pivoting of the associated one of said end plates when said conversion assembly is in the table position;

a plurality of lock assemblies being coupled to said side plates and said wing plates, said lock assemblies securing said wing plates to said side plates when said conversion assembly is in the table position, said lock assemblies being actuated to permit separation of said wing plates from said side plates when said conversion assembly is being manipulated into the chair position, each of said lock assemblies comprising:

a mounting plate, each of said side plates having said mounting plate of one of said lock assemblies mounted thereto, each of said wing plates hingedly coupled to said front plate having said mounting plate of one of said lock assemblies coupled thereto;

a bar being slidably coupled to said mounting plate, said bar being slid between a retracted state and an extended state;

a securing hasp slidably receiving said bar when said bar is in the extended state from said mounting plate to secure said wing plates to said side plates, each of said side plates having said securing hasp of one of said lock assemblies coupled thereto and aligned with said mounting plate mounted to one of said wing plates hingedly coupled to said front plate, each of said wing plates hingedly coupled to said rear plate having said securing hasp of one of said lock assemblies coupled thereto and aligned with said mounting plate coupled to and adjacently positioned one of said side plates; and a pair of upright hasps, each of said longitudinal edges of said rear plate having one of said upright hasps coupled thereto, each of said upright hasps receiving said bar mounted to an adjacently position one of said side plates to secure said rear plate to said side plates when said side plates and said rear plate are in the upright position.

12. A convertible table system for saving space on a boat, said device comprising:

a pedestal being mounted to and extending upwardly from a deck of the boat; and a conversion assembly being mounted to said pedestal to position said conversion assembly above the deck, said conversion assembly being actuatable between a table position and a chair position;

a base plate being mounted to the pedestal, said base plate being orientated approximately parallel to the deck;

a pair of said plates being hingedly coupled to said base plate, each of said side plates being positioned horizontally and aligned with said base plate when said conversion assembly is in the table position, each of a pair of side edges having one of said side plates hingedly coupled adjacent thereto and extending upwardly therefrom when said conversion assembly is in the chair position;

a pair of end plates being hingedly coupled to said base plate, each of said end plates being positioned horizontally and aligned with said base plate when said conversion assembly is in the table position, said end plates including a rear plate and a front plate, a rear edge of said base plate having said rear plate hingedly coupled adjacent thereto and extending upwardly therefrom when said conversion assembly is in the chair position, a front edge of said base plate having said front plate hingedly coupled adjacent thereto and extending downwardly therefrom when said conversion assembly is in the chair position; and an extension bar being slidably coupled to said front plate, said extension bar being slid under said base plate to inhibit downward pivoting of the associated one of said end plates when said conversion assembly is in the table position.

13. The system according to claim 12, wherein said conversion assembly includes a plurality of abutment plates being coupled to a bottom surface of said base plate, each of said side edges having one of said abutment plates coupled adjacent thereto and extending outwardly therefrom, said abutment plates abutting said side plates to keep said side plates approximately horizontal when said conversion assembly is in the table position.

14. The system according to claim 13, wherein said rear edge of said base plate has one of said abutment plates coupled adjacent thereto and extending outwardly therefrom, said abutment plate abutting said rear plate to keep said rear plate approximately horizontal when said conversion assembly is in the table position.

15. The system according to claim 12, wherein said conversion assembly includes a plurality of wing plates, each of a pair of longitudinal edges of each of said end plates having one of said wing plates hingedly coupled adjacent thereto, a pair of said wing plates being aligned with one of said side plates when said conversion assembly is in the table position, each of said wing plates being secured to one of said side plates to maintain positioning of said wing plates when said conversion assembly is in the table position, said wing plates being extended downwardly from said end plates to permit said end plates to be pivoted with respect to said base plate.

16. The system according to claim 15, wherein said conversion assembly includes a plurality of lock assemblies being coupled to said side plates and said wing plates, said lock assemblies securing said wing plates to said side plates when said conversion assembly is in the table position, said lock assemblies being actuated to permit separation of said wing plates from said side plates when said conversion assembly is being manipulated into the chair position.

17. The system according to claim 16, wherein each of said lock assemblies includes a mounting plate, each of said side plates having said mounting plate of one of said lock assemblies mounted thereto, each of said wing plates hingedly coupled to said front plate having said mounting plate of one of said lock assemblies coupled thereto.

18. The system according to claim 17, wherein each of said lock assemblies includes a bar being slidably coupled to said mounting plate, said bar being slid between a retracted state and an extended state.

19. The system according to claim 18, wherein each of said lock assemblies includes a securing hasp slidably receiving said bar when said bar is in the extended state from said mounting plate to secure said wing plates to said side plates, each of said side plates having said securing hasp of one of said lock assemblies coupled thereto and aligned with said mounting plate mounted to one of said wing plates hingedly coupled to said front plate, each of said wing plates hingedly coupled to said rear plate having said securing hasp of one of said lock assemblies coupled thereto and aligned with said mounting plate coupled to and adjacently positioned one of said side plates.

20. The system according to claim 18, wherein each of said lock assemblies includes a pair of upright hasps, each of said longitudinal edges of said rear plate having one of said upright hasps coupled thereto, each of said upright hasps receiving said bar mounted to an adjacently position one of said side plates to secure said rear plate to said side plates when said side plates and said rear plate are in the upright position.

* * * * *